US005392926A

United States Patent [19]

Schäfer

[11] Patent Number: 5,392,926

[45] Date of Patent: Feb. 28, 1995

[54] GARBAGE CONTAINER, IN PARTICULAR, A LARGE-VOLUME GARBAGE CONTAINER WITH AN IDENTIFICATION UNIT

[75] Inventor: Gerhard Schäfer, Neunkirchen-Salchendorf, Germany

[73] Assignee: Fritz Schäfer Gesellschaft mit beschränkter Haftüng, Neunkirchen, Germany

[21] Appl. No.: 36,794

[22] Filed: Mar. 25, 1993

[30] Foreign Application Priority Data

Mar. 28, 1992 [DE] Germany ..... 9204254[U]

[51] Int. Cl.[6] ..... B07C 5/00

[52] U.S. Cl. ..... 209/546; 220/908; 209/569; 209/930

[58] Field of Search ..... 220/908, 909, 910, 911; 209/1, 2, 546, 569, 930

[56] References Cited

U.S. PATENT DOCUMENTS

| | | | |
|---|---|---|---|
| 5,015,143 | 5/1991 | Carson | 220/909 X |
| 5,121,853 | 6/1992 | Edelhoff | 220/908 X |
| 5,171,119 | 12/1992 | Carson | 220/909 X |
| 5,201,434 | 4/1993 | DeVivo et al. | 220/908 X |

FOREIGN PATENT DOCUMENTS

| | | | |
|---|---|---|---|
| 8612623 | 10/1986 | Germany . | |
| 9101818 | 2/1991 | WIPO | 209/930 |

*Primary Examiner*—D. Glenn Dayoan
*Attorney, Agent, or Firm*—Anderson Kill Olick & Oshinsky

[57] ABSTRACT

A large-volume container has a receptacle, which is closed by a suspended cover, and an unloading catch, which is secured to the receptacle beneath its filling opening and which is formed as a collar-like hollow profile having a wall with an aperture, through which a radially expandable case of an identification unit is inserted into the cavity of the hollow profile.

11 Claims, 3 Drawing Sheets

FIG. 1
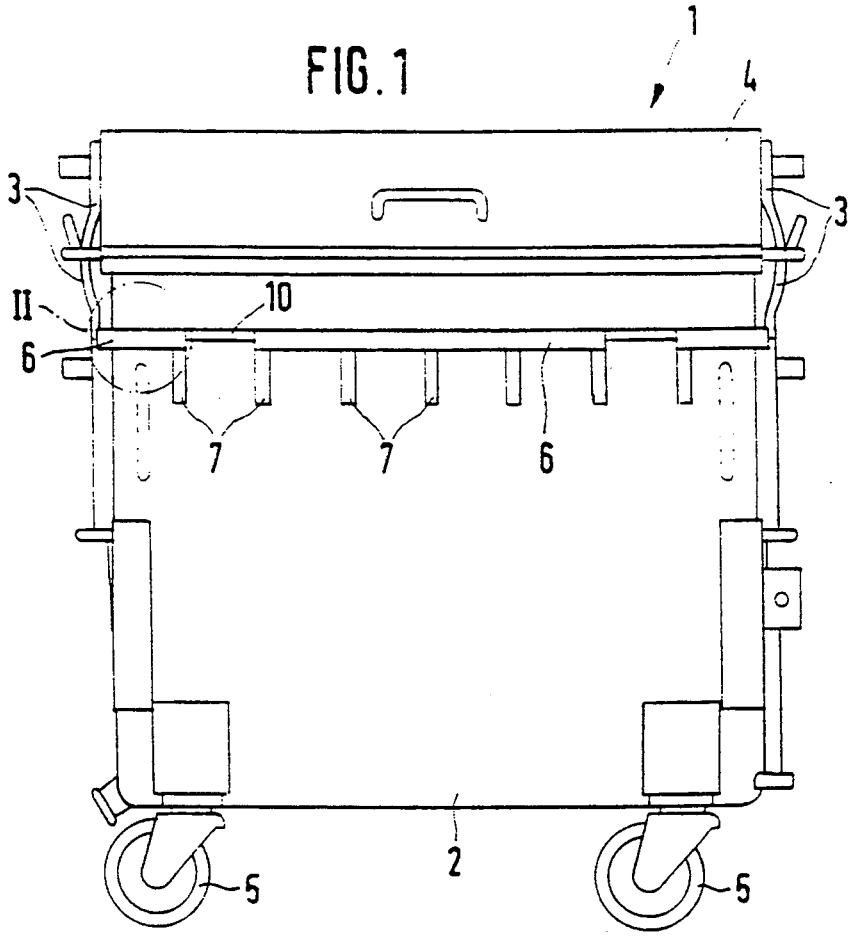
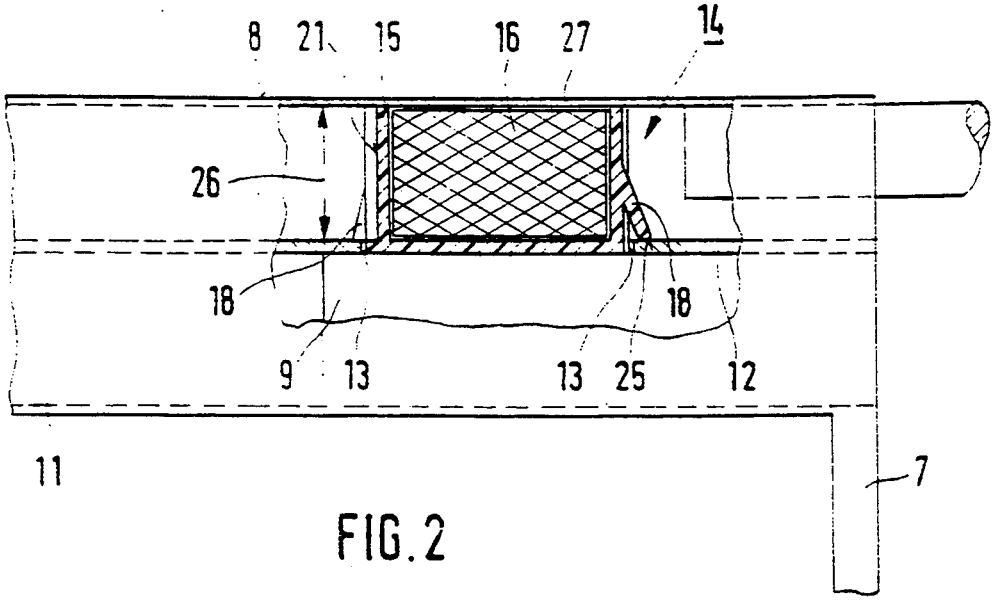
FIG. 2

GARBAGE CONTAINER, IN PARTICULAR, A LARGE-VOLUME GARBAGE CONTAINER WITH AN IDENTIFICATION UNIT

FIELD OF THE INVENTION

The invention relates to a garbage container, in particular, to a large-volume garbage container, with an identification unit that cooperates with an on-board identification system which is associated with an emptying device of a garbage collection truck.

BACKGROUND OF THE INVENTION

An automatic identification of garbage containers is known, e.g., an automatic identification of a garbage container is disclosed in German Utility Model 86 12 623.7. In GE-UM 86 12 623.7, the identification unit is mounted on the garbage container and, during unloading, it cooperates with an electrical recognition element of a garbage truck. The identification unit, during unloading of the container, is automatically intercepted by the recognition element, which receives an appropriate information from the identification unit of the container, which not only enables a precise weight evaluation of the garbage contained in a respective manner but also permits to assign the respective quantity of the garbage to a respective entity and then to correctly establish a separate weight-related debit note. The identification unit can, e.g., provide, in a code form, which is recognizable by the recognition element, a name and an user number of the container owner and the like. The recognition element can intercept the information from the identification unit, e.g., by optical, electrical, magnetic or any other means.

Thus, there is not incentive for individuals and businesses to claim a reduced amount of garbage during the determination of the estimated garbage disposal fees. Therefore, an individual weight-related calculation of the garbage disposal fees works better toward the reduction of an accumulated amount of garbage. Also, an entity or entities in this way are encouraged to sort, e.g., biological waste, recycling garbage, and non-recyclable garbage so that they can be collected separately. If then the fee calculation for different types of garbage is based on correspondingly different tariff units, the actual garbage disposal can be optimized.

The above-described way of garbage disposal requires that the identification unit on the garbage container includes a device which not only insures error-free communication with the on-board identification system or recognition element of the garbage truck, but is also robust and long-lasting. Because, as a rule, the garbage container has a rim region, a so-called unloading catch, for emptying the content into the garbage truck, the known identification unit is located near the garbage container rim. For protecting the identification unit, e.g., against unfavorable weather conditions and/or mechanical damages from an impact, the identification unit is placed under the thick rim of the garbage container and is provided with a protecting cover. The identification unit, which is formed as a plaque or a disc, is inserted in a recess formed in the outer wall of the container or into a pocket screwed thereto.

The object of the invention is to facilitate mounting of an identification unit in a garbage container, particularly in a large-volume garbage container.

SUMMARY OF THE INVENTION

This and other objects of the invention, which become apparent hereinafter, are achieved by providing an aperture in a wall of a collar-like hollow profile of a garbage container, preferably in a wall of the unloading catch, through which aperture, a radially expandable sensor case of the identification unit, which is open at one side, is inserted, with the case being received, after passing the aperture, in the available cavity of the hollow profile. Providing such a hollow profile permits to protect the identification unit from all sides, without a need for using additional cover means, by encapsulation of the case. Because the case, which is preferably, as well as the opening, made cylindrical, expands radially after being inserted in the cavity of the hollow profile, the diameter of the case is greater than that of the aperture and it cannot, therefore, fall out of the cavity.

According to one embodiment of the invention, the outer surface of the case is provided with sloping protruding resilient webs or ribs. Thereby, radial expansion of the case is achieved in a simple manner by the use of the sloping protruding resilient ribs. During insertion of the case through the aperture into the cavity of the hollow profile on the wall of the garbage container, the resilient ribs lie closely against the outer surface of the case and, after passing the aperture, they immediately expand to their initial protruding position, in which position the case, because of the sloping nature of the resilient ribs, has a conically expanding shape from its open top to its bottom end.

If the free ends of the resilient ribs of the case end above the case bottom and have, preferably, a length corresponding to the width between the apertured wall and another wall of the hollow profile located opposite the apertured wall, a fixing position of the case in the hollow profile is obtained, without a need for any further anchorage. Thus, it is achieved, on the one side, that the case, due to the expandable resilient ribs, does not fall out through the opening, and, on the other side, that the case bottom extends into the aperture, which results from the resilient ribs ending above the bottom and extending in the space between the opposite walls of the hollow profile. Both these features thereby exclude undesirable displacement of the case in the hollow profile. Thus, the case is not loose, which might have caused it damage, and an improper replacement of the identification unit is prevented.

The case can be so formed that the resilient ribs are regularly spaced from each other with rib-free surface portions. By providing alternatively, a resilient rib and a rib-free surface portion, with the width of the resilient rib and the rib-free portion being approximately equal, a proper rigidity is achieved, despite the flexibility of the resilient ribs or the case.

If, advantageously, the rib-free outer surface portions are provided with recesses which, preferably, extend from the case top to the case bottom with a decreasing depth, a different wall thickness of the case is obtained. Namely, the wall from the bottom to the top has a conical shape or tapers from the bottom up. As a result, the leading end of the case, which is being first inserted into the aperture, is more flexible than the rear, bottom end of the case, and this favors the desired radial increase or decrease in the case diameter.

The height of the case bottom, e.g., in the regions of the rib-free outer surface portion, is so selected that the centering of the case, in the aperture is achieved.

The above-mentioned and other features and objects of the invention and the manner of obtaining the same will become more apparent and the invention itself will be best understood from the following detailed description of the preferred embodiment when read with reference to the accompanying drawings.

BRIEF DESCRIPTION OF THE DRAWINGS

FIG. 1 shows a front elevational view of a large volume garbage container with an integrated identification unit;

FIG. 2 shows a partially cross-sectional view of a region of the garbage container designated in FIG. 1 with II and limited with a dash-dot circle, and which includes, in a hollow space thereof, a sensor case;

DETAILED DESCRIPTION OF THE PREFERRED EMBODIMENT

Figure 3:
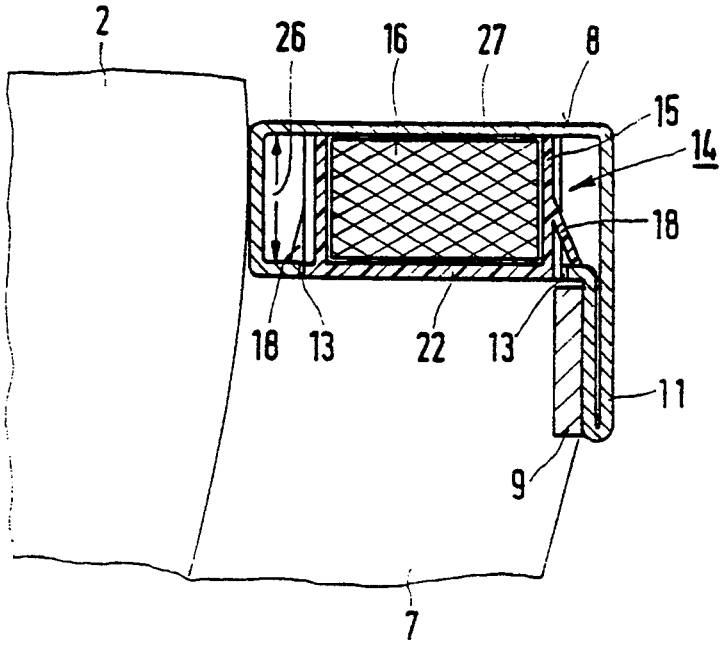
FIG. 3 shows a cross-sectional view of the sensor case according to FIG. 2.

A large-volume garbage container 1 shown in FIG. 1 includes an actual garbage receptacle 2 and a cover 4, which is suspended on lifting rods 3, for closing the receptacle 2. The garbage container 1 is supported on four running wheels 5, so that it can be moved toward a garbage truck (not shown) for being emptied. Somewhat beneath a filling opening of the garbage container 1, which is closed with the cover 4, there is provided, on the front side of the garbage container, an unloading catch 6 which is reinforced by ribs 7. It serves for emptying the garbage container 1. The emptying or unloading device of a garbage truck (not shown) seizes the unloading catch 6 of the receptacle 2 to effect lifting, tilting and lowering steps of the emptying cycle. For better handling, the garbage container 1 is provided with handles 10.

The unloading catch 6 in a form of a collar is attached to the receptacle 2 and forms, e.g., a welded hollow profile 8. It is provided at its end, which projects toward the receptacle 2, with a skirt 11 which extends downward and is formed by a bent profile. The lower wall 12 of the hollow profile 8 is provided with a cylindrical aperture 13 through which a cylindrical sensor case 15 is inserted into a cavity 14 of the hollow profile 8. The case 15 receives an identification element 16 which is shown with criss-cross hatchings in FIGS. 2 and 3. The identification element 16, after insertion of the sensor case 15 into the cavity 14, is completely encapsulated and protected in its location in the unloading catch 6 (see the dash-dot circle in FIG. 1). The identification unit, in this position, can communicate without any problems with an on-board identification system of the garbage truck.

Figure 4:
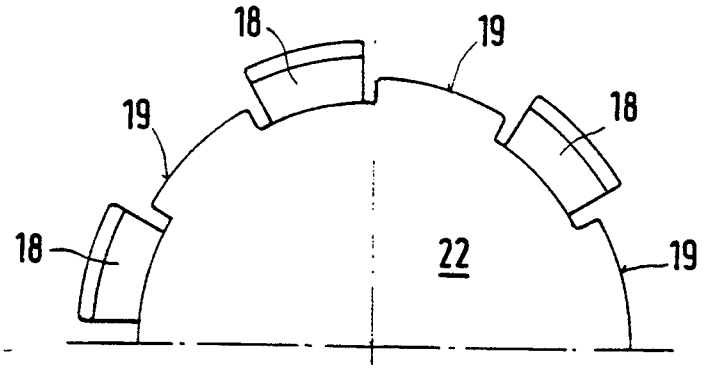
FIG. 4 shows a bottom view of a sensor case according to the invention, with only one-half being shown.
Figure 6:
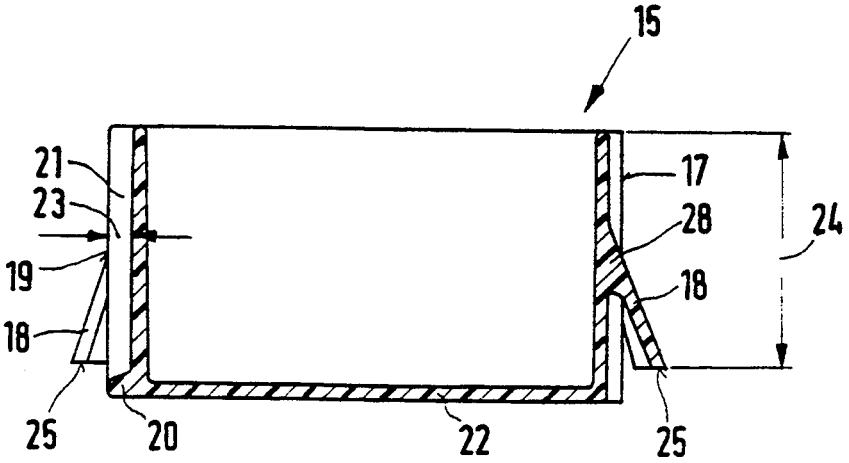
FIG. 6 shows a cross-sectional view of a sensor case according to FIG. 5 along line VI—VI.
Figure 5:
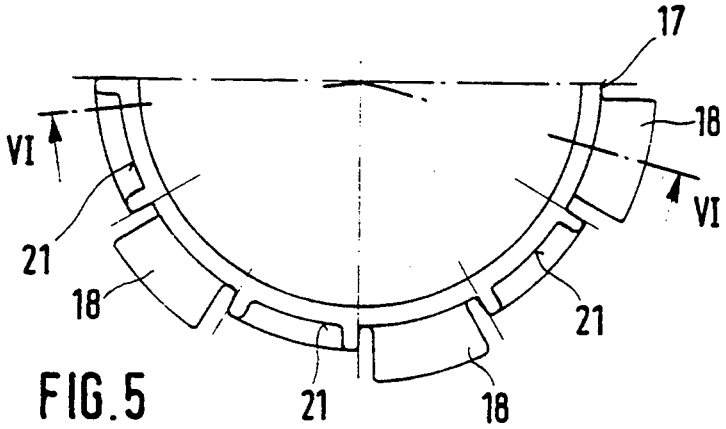
FIG. 5 shows a top view of an open sensor case according to the invention, with only one-half being shown.

The sensor case 15 shown in FIGS. 4–6 is formed of a plastic material by injection molding. A plurality of protruding regularly spaced sloping ribs 18 are arranged in an outer surface 17 of the sensor case 15, with rib-free outer surface portions 19 located between respective pairs of ribs 18. The rib-free outer surface portions 19 are provided with recesses 21, which extend from the open top of the cup-shaped sensor case 15 to the bottom 22 with a decreasing depth 23, as shown in FIG. 6. The sensor case 15 has in the region of surface portions 19 at the case bottom 22, lugs 20 which center the case 15 in the apertures 13.

The length 24 of a resilient web 18, which is taken from the top open end of the case 15 to the free end 25 of the ribs, corresponds to the width 26 between the bottom wall 12 and the opposite wall 27 of the profile 8, as can be seen in FIGS. 2 and 3. Thickenings 28, which are formed on the outer surface 17 of the case 15 and integrally with the ribs 18 during an injection molding process, are located approximately at the middle of the height of the case 15.

When a garbage container 1 is being equipped with an identification element 16, the identification element 16 is placed in the case 15 from its open end, and the case 15 is then inserted, with its open end leading, through the aperture 13 in the bottom wall 12 into the hollow profile 8. When the case 15 passes through the aperture 13, the protruding resilient ribs 18 are pressed against the outer surface 17 of the case 15. As soon as the case 15 is inserted into the cavity 14 so deep, that its open top end abuts a wall 27 of the hollow profile 8, which is located opposite the bottom wall 12, the identification element 16 is isolated from the outside, at all sides. At that, the resilient ribs 18, because of correspondence of the length 24 to the width 26 of the hollow profile 28, are freely positioned in the cavity 14 immediately above the aperture 13. In this position, the resilient ribs 18 bounce back to their initial protruding position, as shown in FIGS. 2 and 3. The free ends 25 of the resilient ribs 18 lie on the inner surface of the bottom wall 12 of the hollow profile 8. Simultaneously, the radially expanding resilient ribs 18 of the case 15 prevent the case from falling out through the aperture 13, because the expanding resilient ribs 18 increase the outer diameter of the case 15 with respect to that of the aperture 13. For compensating a possible vertical play, a resilient layer, e.g., a rubber sponge may be provided on the case 15 or in the identification region II.

Because the free ends 25 of the resilient ribs 18 end above the case bottom 22 and beyond the dimension of the case proper, the case 15, at its bottom end, extends in the aperture 13 so wide that it cannot move radially from its mounting position in the cavity 14. The aperture 13, in this case, serves as limiting stop and prevents any radial displacement of the case 15. Thus, the identification unit 16, with the help of the case 15, can be placed in a desired position in the garbage container 1, without a need in provision of any cover and/or other attachment means.

While a particular embodiment of the invention has been shown and described, various modification thereof will be apparent to those skilled in the art and therefore it is not intended that the invention be limited to the disclosed embodiment or to the details thereof, and departures may be made therefrom within the spirit and scope of the invention as defined in the appended claims.

What is claimed is:

1. A garbage container, comprising a collar-like hollow profile secured to said garbage container and having a wall with an aperture formed therein; and an identification unit located in said hollow profile for cooperation with an identification system associated with an emptying device of a garbage collecting truck, said identification unit including a radially expandable case.

2. A garbage container according to claim 1, wherein said hollow profile forms an unloading catch.

3. A garbage container according to claim 1, wherein said case has an outer surface with sloping resilient ribs protruding therefrom.

4. A garbage container according to claim 3, wherein said case has a bottom, said resilient ribs have free ends which end above said bottom.

5. A garbage container according to claim 3, wherein the hollow profile has another wall located opposite the apertured wall, and the resilient ribs have a length that corresponds to a width between the opposite walls of said hollow profile.

6. A garbage container according to claim 3, wherein a rib-free outer surface portion is located between each pair of adjacent resilient ribs.

7. A garbage container according to claim 6, wherein each rib-free outer surface portion is provided with an outer recess.

8. A garbage container according to claim 7, wherein said recess extends from a top of said case to a bottom thereof with a decreasing depth.

9. A garbage container according to claim 4, wherein said bottom has lugs at a level thereof.

10. A garbage container according to claim 1, wherein said aperture and said case are cylindrical.

11. A garbage container according to claim 1, wherein said case is an injection-molded part.

* * * * *